US008555785B2

(12) United States Patent
Cross

(10) Patent No.: US 8,555,785 B2
(45) Date of Patent: Oct. 15, 2013

(54) SHOTSHELL WAD WITH SHOT CONFINEMENT FEATURE

(75) Inventor: Kevin R. Cross, Austin, AR (US)

(73) Assignee: RA Brands, L.L.C., Madison, NC (US)

( * ) Notice: Subject to any disclaimer, the term of this patent is extended or adjusted under 35 U.S.C. 154(b) by 102 days.

(21) Appl. No.: 12/695,586

(22) Filed: Jan. 28, 2010

(65) Prior Publication Data

US 2010/0192794 A1 Aug. 5, 2010

Related U.S. Application Data

(60) Provisional application No. 61/149,059, filed on Feb. 2, 2009.

(51) Int. Cl.
*F42B 7/08* (2006.01)

(52) U.S. Cl.
USPC ..... 102/451; 102/461; 102/532

(58) Field of Classification Search
USPC ..... 102/449, 450, 451, 453, 456, 457, 461, 102/532
See application file for complete search history.

(56) References Cited

U.S. PATENT DOCUMENTS

| | | | |
|---|---|---|---|
| 219,840 | A | 9/1879 | Winchester |
| 419,220 | A | 1/1890 | Scanland |
| 681,091 | A | 8/1901 | Adamson |
| 1,659,649 | A | 2/1928 | Ernst et al. |
| 1,771,897 | A | 7/1930 | O'Neil et al. |
| 1,872,107 | A | 8/1932 | Bond |
| 1,908,314 | A | 5/1933 | Brownsdon |
| 2,476,291 | A | 7/1949 | Garber |
| 2,665,635 | A | 1/1954 | Morel |
| 2,788,744 | A | 4/1957 | Donner |
| 2,953,816 | A | 9/1960 | Kidder |
| 2,973,711 | A | 3/1961 | Clark, Jr. |
| 2,986,998 | A | 6/1961 | Clark, Jr. |
| 3,022,731 | A | 2/1962 | Yeomans, Jr. |
| 3,022,734 | A | 2/1962 | Kidder |
| 3,053,185 | A | 9/1962 | Oberfell et al. |
| 3,058,420 | A | 10/1962 | Tanner et al. |
| 3,095,817 | A | 7/1963 | Clark, Jr. |
| 3,120,807 | A | 2/1964 | Lyon |
| 3,138,102 | A | 6/1964 | Meyer et al. |

(Continued)

FOREIGN PATENT DOCUMENTS

| | | |
|---|---|---|
| DE | 1808779 | 6/1970 |
| FR | 1 255 993 A | 3/1961 |

(Continued)

OTHER PUBLICATIONS

International Search Report mailed Feb. 3, 2010, PCT/US2009/062180, filed Oct. 27, 2009.

(Continued)

*Primary Examiner* — James Bergin
(74) *Attorney, Agent, or Firm* — Womble Carlyle Sandridge & Rice, LLP

(57) ABSTRACT

A wad for ammunition cartridges, including shotshell cartridges, includes a wad body having a series of separable fingers. A shot confinement tube is located within the wad body, surrounded by the separable fingers. The confinement tube extends longitudinally along the wad body and defines a recess in which an ammunition payload is received and is contained upon firing of the ammunition cartridge and as the wad is separated from the ammunition payload.

11 Claims, 4 Drawing Sheets

(56) References Cited

U.S. PATENT DOCUMENTS

| | | | | | |
|---|---|---|---|---|---|
| 3,180,265 | A | | 4/1965 | Rybak | |
| 3,191,534 | A | | 6/1965 | Vecchiotti | |
| 3,211,100 | A | | 10/1965 | Clark, Jr. | |
| 3,215,076 | A | | 11/1965 | Foote et al. | |
| 3,217,648 | A | | 11/1965 | Foote et al. | |
| 3,221,658 | A | | 12/1965 | Devaux | |
| 3,234,877 | A | | 2/1966 | Herter | |
| 3,262,392 | A | | 7/1966 | Becker et al. | |
| 3,266,421 | A | | 8/1966 | Comerford | |
| 3,279,375 | A | | 10/1966 | Herter | |
| 3,280,745 | A | | 10/1966 | Mattarelli | |
| 3,285,174 | A | | 11/1966 | Moehlman et al. | |
| 3,289,586 | A | | 12/1966 | Horn et al. | |
| 3,298,313 | A | | 1/1967 | Comerford | |
| 3,299,813 | A | | 1/1967 | Rickey | |
| 3,402,664 | A | | 9/1968 | Cramer | |
| 3,420,178 | A | | 1/1969 | Rempel | |
| 3,422,762 | A | | 1/1969 | Clark, Jr. | |
| 3,427,920 | A | | 2/1969 | Clark, Jr. | |
| 3,469,527 | A | | 9/1969 | Pace | |
| 3,503,332 | A | | 3/1970 | De Gregorio | |
| 3,507,221 | A | | 4/1970 | Grolly | |
| 3,565,010 | A | | 2/1971 | Sahlmann | |
| 3,598,054 | A | | 8/1971 | Webb et al. | |
| 3,653,326 | A | | 4/1972 | Howsam et al. | |
| 3,662,683 | A | | 5/1972 | Merritt | |
| 3,670,650 | A | | 6/1972 | McCaffrey et al. | |
| 3,707,915 | A | | 1/1973 | Kerzman | |
| 3,720,171 | A | | 3/1973 | Hubbard | |
| 3,721,197 | A | | 3/1973 | Hughes et al. | |
| 3,722,420 | A | | 3/1973 | Herter | |
| 3,727,557 | A | | 4/1973 | Starcevich | |
| 3,730,095 | A | * | 5/1973 | Lage | 102/451 |
| 3,750,579 | A | | 8/1973 | Bellington | |
| 3,750,580 | A | | 8/1973 | Nomura et al. | |
| 3,788,224 | A | | 1/1974 | Merritt | |
| 3,804,019 | A | | 4/1974 | Hurley | |
| 3,812,784 | A | | 5/1974 | Herter | |
| 3,835,783 | A | | 9/1974 | Curran | |
| 3,974,775 | A | | 8/1976 | Kerzman et al. | |
| 3,978,794 | A | | 9/1976 | Fiocchi | |
| 4,004,522 | A | | 1/1977 | Furniss et al. | |
| 4,103,621 | A | * | 8/1978 | Fackler | 102/453 |
| 4,151,799 | A | | 5/1979 | Jackson | |
| 4,164,903 | A | | 8/1979 | Bouza | |
| 4,220,090 | A | | 9/1980 | Fackler | |
| 4,291,625 | A | | 9/1981 | Stagg, Jr. | |
| 4,295,426 | A | | 10/1981 | Genco et al. | |
| 4,307,664 | A | | 12/1981 | Vollers | |
| 4,452,144 | A | | 6/1984 | Maki | |
| 4,553,481 | A | | 11/1985 | Ricci | |
| 4,574,701 | A | | 3/1986 | Fiocchi | |
| 4,587,905 | A | | 5/1986 | Maki | |
| 4,627,356 | A | * | 12/1986 | Buczkowski | 102/453 |
| 4,669,385 | A | * | 6/1987 | Maki | 102/453 |
| 4,676,170 | A | | 6/1987 | Roster | |
| 4,733,613 | A | | 3/1988 | Bilsbury et al. | |
| 4,773,329 | A | | 9/1988 | Bilsbury | |
| 4,776,279 | A | | 10/1988 | Pejsa | |
| 4,782,759 | A | | 11/1988 | Hawk | |
| 4,815,388 | A | | 3/1989 | Schluckebier et al. | |
| 4,860,661 | A | | 8/1989 | Bock et al. | |
| 4,970,959 | A | | 11/1990 | Bilsbury et al. | |
| D314,806 | S | | 2/1991 | Cole | |
| 5,105,713 | A | | 4/1992 | Wirgau | |
| 5,171,934 | A | | 12/1992 | Moore | |
| 5,214,238 | A | | 5/1993 | Young | |
| 5,235,915 | A | | 8/1993 | Stevens | |
| 5,239,928 | A | | 8/1993 | Ricci | |
| 5,299,502 | A | * | 4/1994 | Maki | 102/457 |
| 5,339,743 | A | | 8/1994 | Scarlata | |
| 5,347,932 | A | | 9/1994 | Gardner et al. | |
| 5,471,931 | A | | 12/1995 | Gardner | |
| 5,623,118 | A | | 4/1997 | Jackson | |
| 5,792,979 | A | | 8/1998 | Pietro | |
| 5,837,927 | A | | 11/1998 | Buenemann, Jr. | |
| 5,861,572 | A | | 1/1999 | Schuermann | |
| 5,874,689 | A | * | 2/1999 | Alkhatib et al. | 102/453 |
| 5,970,878 | A | | 10/1999 | Gardner | |
| 5,979,330 | A | | 11/1999 | Cornell | |
| 6,067,909 | A | | 5/2000 | Knoster, Jr. | |
| 6,161,482 | A | | 12/2000 | Clark | |
| 6,164,209 | A | | 12/2000 | Best et al. | |
| 6,260,484 | B1 | | 7/2001 | Billings | |
| 6,367,388 | B1 | | 4/2002 | Billings | |
| 7,243,603 | B2 | * | 7/2007 | Sheaffer | 102/449 |
| 2004/0069177 | A1 | | 4/2004 | Klein | |
| 2005/0039627 | A1 | | 2/2005 | Zanoletti | |
| 2005/0188882 | A1 | | 9/2005 | Diller | |
| 2007/0012212 | A1 | | 1/2007 | Sheaffer | |

FOREIGN PATENT DOCUMENTS

| | | | |
|---|---|---|---|
| FR | 78 417 | E | 7/1962 |
| FR | 1 534 004 | | 7/1968 |
| FR | 2 343 218 | | 9/1977 |
| FR | 2 687 217 | A1 | 8/1993 |
| IT | 427344 | | 9/1948 |
| WO | WO 95/10752 | A1 | 4/1995 |

OTHER PUBLICATIONS

International Search Report mailed Mar. 5, 2010, PCT/US2010/022523, filed Jan. 29, 2010.
English translation of foreign patent # FR 1 255 993A.
English translation of foreign patent # FR 78 417 E.

* cited by examiner

SHOTSHELL WAD WITH SHOT CONFINEMENT FEATURE

CROSS-REFERENCE TO RELATED APPLICATIONS

The present Patent Application is a formalization of previously filed, U.S. Provisional Patent Application Ser. No. 61/149,059, filed Feb. 2, 2009, entitled "Shot Confinement Wad" by the inventors named in the present Application. This Patent Application claims the benefit of the filing date of this cited Provisional Patent Application according to the statutes and rules governing provisional patent applications, particularly 35 U.S.C. §119(a)(i) and 37 C.F.R. §1.78(a)(4) and (a)(5). The specification and drawings of the Provisional Patent Application referenced above are specifically incorporated herein by reference as if set forth in their entirety.

FIELD OF THE INVENTION

The present invention generally relates to ammunition such as shotshells, and in particular to a shotshell wad design having a confinement feature for controlling dispersion of the ammunition payload of a shotshell after firing.

BACKGROUND OF THE INVENTION

In the on-going development of shotshells for hunting and other applications, emphasis has been placed on achieving tighter shot patterns for such shot payloads. Shot patterns generally are defined by the percentage of pellets or shot fired from the shell and striking within a circle of a given diameter at a given distance. For example, shot patterns typically are measured based upon the percentage of pellets hitting inside a 30 inch target circle placed at about 40 yards. Poor patterning can lead to much greater spreading of the shot pattern, which can accordingly result in stray shot hitting unintended targets, potentially causing serious injury or damage to other hunters and property. Still further, if the shot pattern or spread is too great, there is also a possibility that the target/game will be seriously wounded and caused to suffer. By providing tighter shot patterns, the accuracy of the shotshells is improved, so that the shotshells are capable of providing more hits on a target. As a result, chances of stray pellets hitting unintended targets are reduced, and providing more hits and ultimately energy on a target further helps ensure humane harvesting of wild game.

It accordingly can be seen that a need exists for improved design shotshells that address the foregoing and other related and unrelated problems in the art.

SUMMARY OF THE INVENTION

Briefly described, the present invention generally relates to a shotshell wad primarily for use with shotshells, although the present invention could be used with various other types of ammunition as well. The shotshell wad generally comprises a base with an upper body portion formed with or attached to the base. A series of two or more separable fingers or petals separated by cuts, slits or other areas of separation define the upper body portion of the shotshell wad.

A confinement feature, such as a shot confinement tube, is located within the upper body portion of the shotshell wad. The confinement feature can be integrally formed with the base or attached thereto and defines a chamber or recess in which an ammunition payload can be received. The ammunition payload typically can comprise a plurality of shot pellets of a desired size, with the confinement feature being appropriately sized to contain a desired payload amount or size.

Upon firing of a shotshell or other type cartridge, the fingers of the shotshell wad will begin to separate and spread as the shotshell wad exits the barrel of the firearm. The spreading fingers encounter aerodynamic drag, which causes separation of the shotshell wad from the ammunition payload contained therein. The ammunition payload, such as a plurality of shot pellets, is contained and maintained within the confinement tube as the fingers spread and separate the shotshell wad from the ammunition payload. As a result, the ammunition payload, such as a grouping of shot pellets, generally is maintained in a conglomerated or contained mass until separation of the shotshell wad therefrom. This in turn causes a delay in the dispersion of the ammunition payload, enabling tighter shot patterns.

Various objects, features and advantages of the present shall become apparent to those skilled in the art upon reading the following Detailed Description, when taken in conjunction with the accompanying drawings.

DETAILED DESCRIPTION

Figure 1:
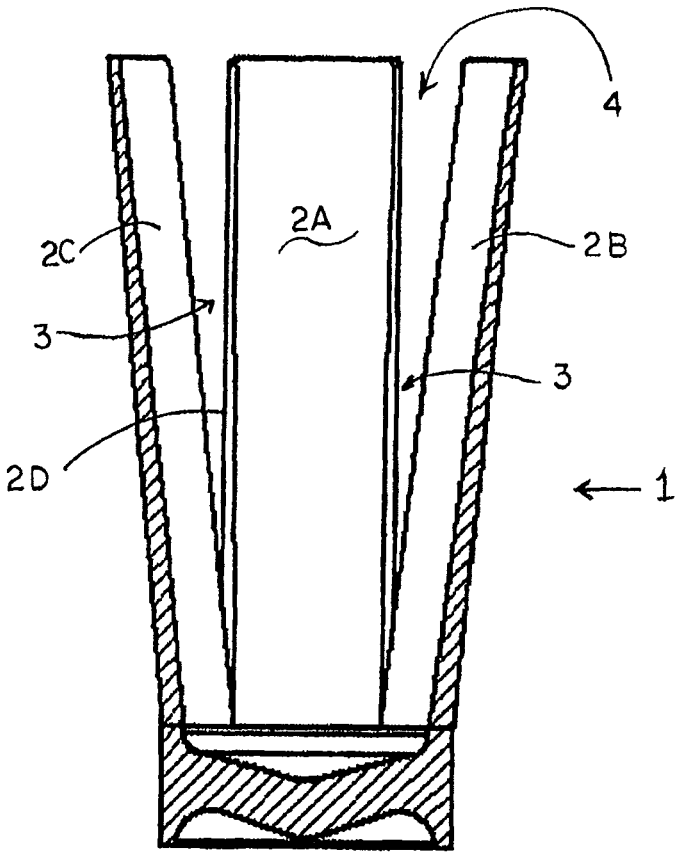
Figure 1 (Prior Art)
FIG. 1 is a side elevational view illustrating a typical prior art shotshell wad design such as for use with steel shot.

Referring now to the drawings in which like numerals indicate like parts throughout the several views, FIG. 1 generally illustrates a conventional shotshell wad design 1, such as typically used with shotshells firing steel shot. Such a wad 1 typically is made from a plastic or other synthetic material and, as is conventional, generally has a series of fingers or sections 2A-2D separated by a series of spaced cuts 3. These fingers, when the wad is inserted into the shotshell, are designed to close together to form a cup 4 in which the shot payload is contained within the shotshell. This cup travels with the payload of shot as the shot travels down the barrel of a firearm after firing of the shotshell until the point at which the shot and cup separate from the barrel of the firearm at the muzzle thereof.

As the shot payload and wad 1 exit the muzzle of the firearm, the fingers 2A-2D of the wad generally are caused to flare outwardly due to wind resistance against the fingers once the wad has left the containment provided by the barrel during firing. Such flaring of the fingers and the resultant aerodynamic drag created thereby helps provide stability to the flight of the shot, while enabling the wad to separate from the shot so that the shot payload can continue toward its intended target while the wad or cup quickly drops away. However, as the fingers of the wad spread outwardly and the wad drops away, the shot payload also loses the confinement provided by the wad and typically begins to spread out or rapidly disperse. As the shot spreads or disperses, the resultant shot pattern is enlarged until a target is struck. As a result, for smaller targets and/or targets at greater distances, there is greater potential for at least some of the shot pellets to miss their intended target. The spreading or dispersal of the shot payload further is often precipitated by the fact that at least a portion of the shot typically will embed into the wad to some degree as a result of the acceleration experienced by the shot payload inside the barrel upon firing.

Figure 2:
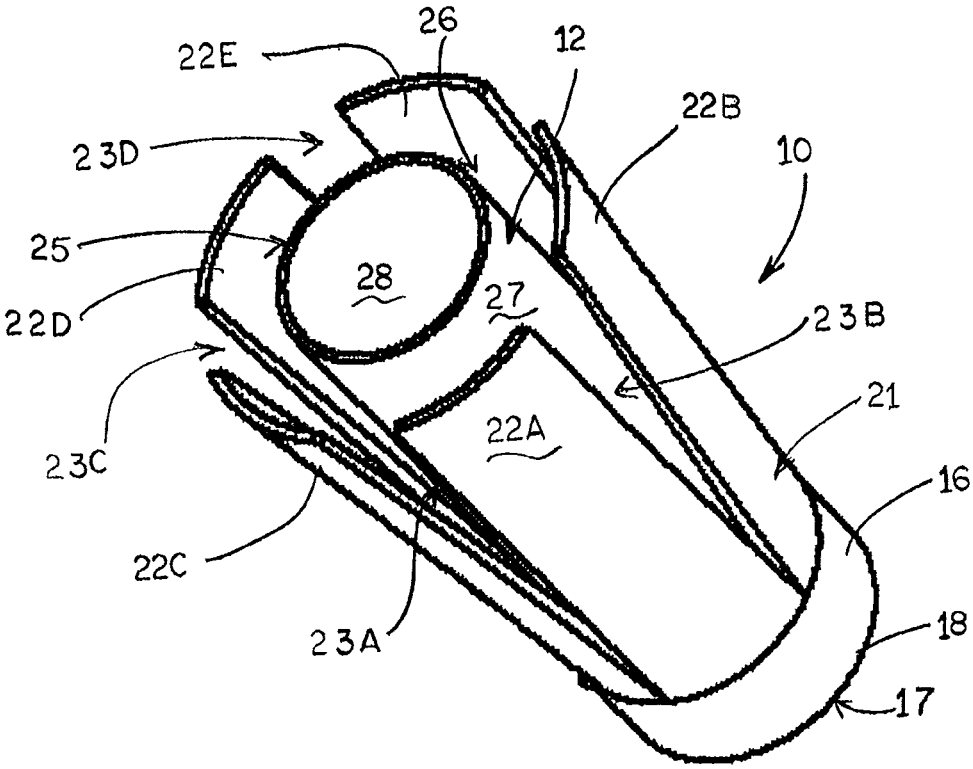
FIG. 2 is a perspective illustration of the shotshell wad with a confinement feature according to the principles of the present invention.
Figure 3A:
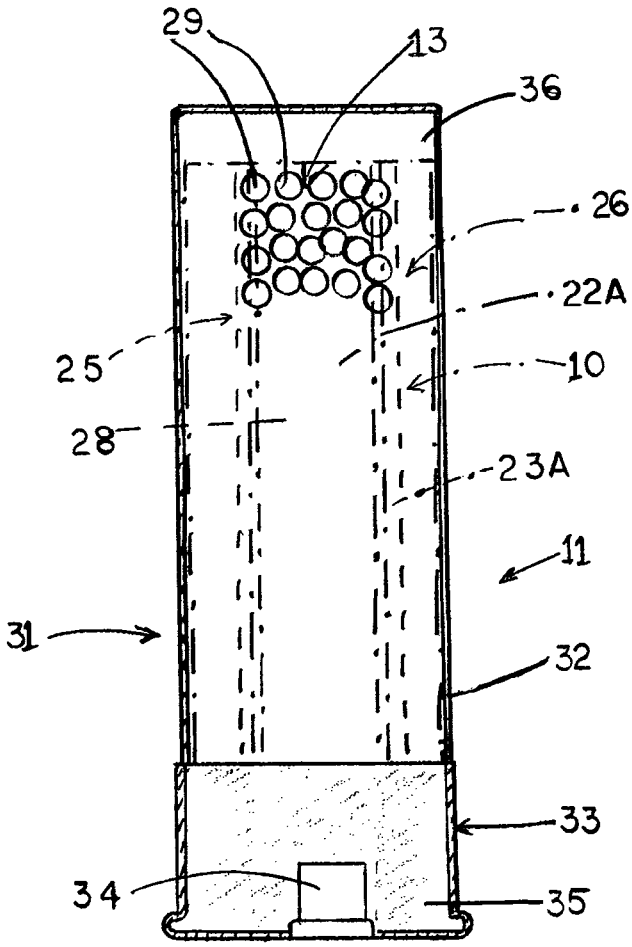
FIG. 3A is a side elevational view of a shotshell with a shot confinement wad according to the principles of the present invention.
Figure 3B:
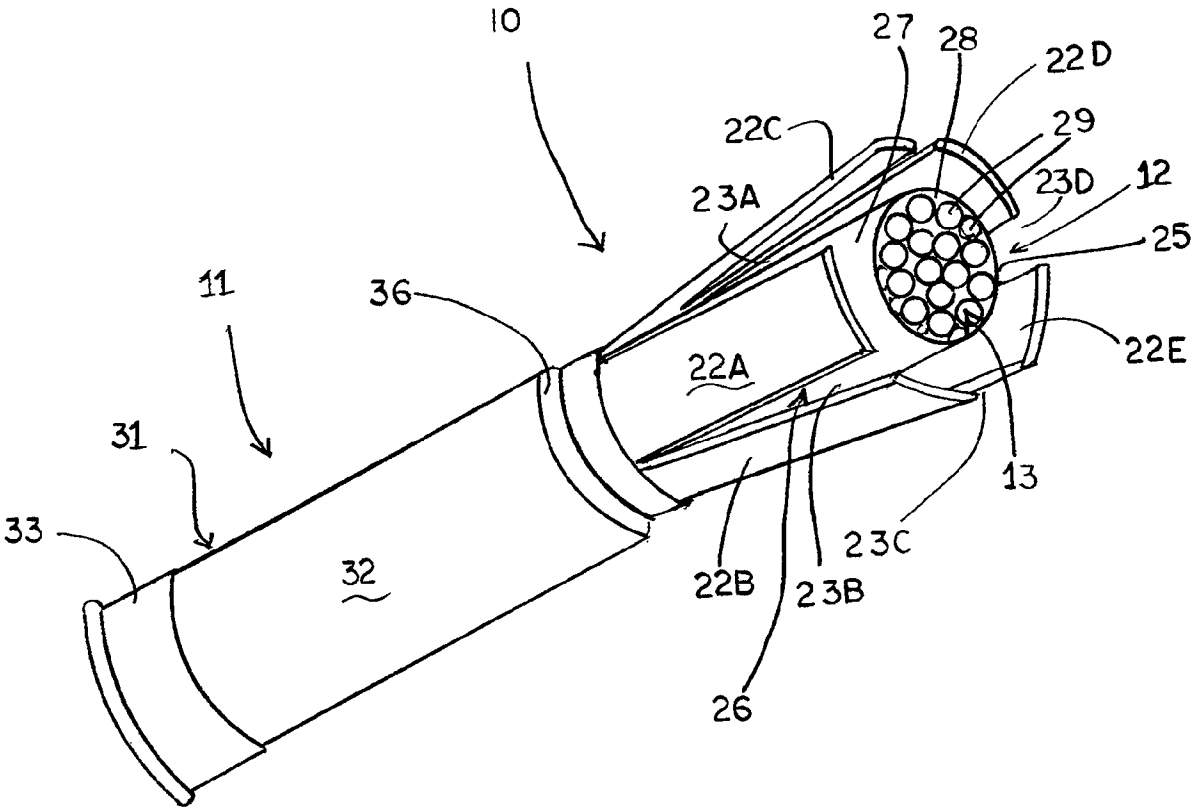
FIG. 3B is an exploded perspective view of the shotshell with a shot confinement wad according to the principles of the present invention.

As illustrated in FIGS. 2-3B, the present invention generally is directed to a shotshell wad design 10 for use in ammunition, primarily shotshells, although other, similar types of ammunition also can be used. The wad 10 generally includes a shot confinement feature 12 that is designed to provide enhanced or increased control of the shot payload 13 of the shotshell 11 during the separation of the shot from the wad after firing. However, the shotshell wad 10 according to the principles of the present invention still achieves or preserves the benefits provided by the aerodynamic drag resulting from operation of flaring fingers for separation of the wad from the shot payload, as well as providing stability to the shot flight leaving the barrel of the firearm.

As illustrated in FIG. 2, the present invention generally comprises a substantially cylindrical shotshell wad 10 having a base 16, which generally can be formed or otherwise provided with a cup or recess 17 in a bottom or rear surface 18 thereof. The wad 10 further generally includes an upper body portion 21 having a series of fingers or sections 22A-22E separated or segmented by vertically extending cuts, slits, slots, recesses, or other areas of separation 23A-23D formed therebetween. The fingers or sections further can be defined by weakened areas in the body of the wad, such as score lines, depressions, stitches, and other, similar separation features, other than fully cutting or segmenting the wad to for the fingers. The shotshell wad also generally is formed from a plastic or synthetic material, as is conventionally used (although other materials such as lightweight metals also could be used as desired), so as to enable the fingers or segments to be somewhat flexible so as to readily flare outwardly as desired upon meeting wind resistance after leaving the muzzle of the firearm barrel upon firing. Additionally, while four-five substantially rectangular flaring fingers, sections or petals are shown in the Figures, it will be understood by those skilled in the art that fewer or greater numbers of flaring fingers formed with a variety of configurations and lengths, also can be utilized as needed or desired.

The shot confinement feature 12 is shown in one example embodiment as comprising a shot confinement tube 25 or container that is provided within the body portion 21 of the shotshell wad 10 as illustrated in FIGS. 2 and 3B. The confinement tube 25 generally can be made from plastic, synthetic or other, similar materials and typically will be substantially centrally located within a recess or interior 26 of the shotshell wad 10 as generally defined by the fingers thereof. The confinement tube 25 can be integrally formed with the base 16 of the shotshell wad, or can be otherwise affixed to the base portion 16 of the shotshell wad, such as by adhesives, heat/welding or other attachment means. In one example embodiment, the confinement tube 25 can have a substantially solid, cylindrical outer wall 27 defining an interior chamber or recess 28 in which a plurality of shot pellets of a desired size or gauge 29 or other ammunition payload 13 of the shotshell 11 will be contained. The containment tube 25 additionally can be formed in a variety of other different configurations, such as rectangular, polygonal, or other configurations defining an interior chamber 28 of sufficient volume and size to receive a desired shot payload size or amount therein.

In use, the shotshell wad 10 with confinement feature 12 according to the present invention can be used in a variety of different shotshell systems, cartridges or ammunition. For example, a shotshell cartridge 11 (FIGS. 3A-3B) in which the shotshell wad 10 is received can be a 12 gauge, 16 gauge, 20 gauge, 410 gauge or other gauge or caliber cartridge or shell. The shotshell 11 further typically can include a hull 31, which can include a tubular body 32 formed from a plastic, metal, or other, similar material and a base or head portion 33 typically formed from metal, with a primer 34 (FIG. 3A) mounted in the base or head portion 33 of the hull 31, and a propellant 35. The shotshell wad 10 with the confinement feature 12 will generally be received within the interior 36 of the shotshell cartridge 11, typically seating on top of the propellant and primer, and will hold the ammunition payload or shot 29 within its interior chamber 28 during firing. It further will be understood that the present invention can be used in a variety of ammunition systems, including for firing slugs or bullets as well as shot pellets or other similar ammunition payloads.

During firing, as indicated in FIG. 3B, as the shotshell wad 10 and shot payload 29 leave the containment of the firearm barrel through the muzzle thereof, the fingers or petals 22A-22D of the shotshell wad 10 are caused to flare outwardly as a result of meeting wind resistance after exiting the muzzle. The outward flaring of the fingers in turn creates aerodynamic drag on the shotshell wad as to cause a separation of the shotshell wad 10 from the shot payload 29 and helps to stabilize the continuing flight of the shot payload. Additionally, during this separation of the shotshell wad from the payload shot 29 the confinement tube 25 helps confine and maintain the shot payload 29 in a more compact or conglomerated mass as the shotshell wad 10 is separated from the shot payload and drops away therefrom for a longer time period as the shotshell wad and shot payload leave the barrel of the firearm and separate. This period of extended confinement accordingly helps delay the dispersion or separation and/or tumbling of the ammunition or shot payload during the separation of the shot payload from the shotshell wad. This delay of the dispersal of the shot payload generally is for a time sufficient to accordingly enable a desired tighter grouping of the shot pattern as the shot is in flight and strikes the intended target, but does not interfere with the separation of the wad from the shot payload or otherwise adversely affect the flight of the shot. It further will be understood by those skilled in the art that the length of the fingers can be adjusted to tune the length of delay as desired for a given payload. For example, extending or reducing the length of the fingers can accordingly increase or reduce the amount of drag or air resistance to which the fingers are subjected, so that the fingers will separate at a faster or slower rate as needed or desired for the ammunition payload of the shotshell wad.

Accordingly, with the shotshell wad of the present invention, the confinement tube helps maintain or contain the collection or grouping of the shot of the ammunition payload for an extended confinement time as the fingers are opened and the shot payload is separated from the wad, while still enabling and providing for the action of aerodynamic drag on the fingers to facilitate separation of the wad from the shot payload, which also helps provide stability to the flight of the ammunition or shot payload as it leaves the wad. This results in tighter patterns than have been found to be achieved by shotshell wads similar in construction to the shotshell wad design shown in FIG. 1.

It further will be understood by those skilled in the art that while the present invention has been described above with respect to one or more desired embodiments, various modifications, changes, additions and deletions can be made thereto without departing from the spirit and scope of the invention.

I claim:

1. A unitary wad for ammunition for containing and stabilizing an ammunition payload upon firing, comprising:

a wad body having a base, a confinement feature extending forwardly and having a substantially solid side wall defining a recess for containing the ammunition payload therein, and a series of separable fingers arranged about the confinement feature;

said base, confinement feature and series of separable fingers of the wad body being integrally formed;

wherein after firing, said ammunition payload is contained within said confinement feature as a substantially conglomerated mass for an extended period of confinement as the separable fingers of said unitary wad open about said confinement feature and encounter aerodynamic drag so as to cause the unitary wad to separate from the ammunition payload.

2. The unitary wad of claim 1 and wherein the ammunition payload comprises a series of shot pellets.

3. The unitary wad of claim 1 and wherein the wad body comprises a lightweight synthetic material.

4. The unitary wad of claim 1 and wherein the series of operable fingers comprises at least 2 fingers separated by a series of longitudinal areas of separation.

5. A wad for ammunition, comprising:

a wad body including a base, a confinement tube having a wall defining a recess for containing an ammunition payload therein, and an upper body portion substantially surrounding and separated from the wall of the confinement tube and having a series of separable fingers formed thereabout;

wherein the base, confinement tube and upper body portion of the wad body define a substantially unitary wad structure; and wherein as the wad body is moved forwardly upon firing, the separable fingers open and encounter aerodynamic drag to cause the confinement tube of the wad body to separate from the ammunition payload with the confinement tube containing the ammunition payload for an extended period of confinement during such separation until the containment tube of the wad body has been separated from the ammunition payload.

6. The wad for ammunition of claim 5, and wherein the confinement tube maintains the shot pellets in a conglomerated mass until the wad body has separated therefrom.

7. The wad for ammunition of claim 5 and wherein the wad body comprises a lightweight synthetic material.

8. The wad for ammunition of claim 5 and wherein the base, confinement tube and fingers of the wad body are integrally formed together from a synthetic material.

9. The wad for ammunition of claim 5 and wherein the confinement tube comprises a substantially centrally aligned, open-ended tube defining a longitudinally extending recess in which the ammunition payload is received.

10. The wad for ammunition of claim 5 and wherein the base of the wad body is formed at an end of the wad body opposite from the confinement tube and defines a recess in which a propellant can be received.

11. The wad for ammunition of claim 5, wherein varying a length of the separable fingers varies a rate of separation of the wad body from the ammunition payload.

* * * * *